United States Patent [19]

Shoham

[11] 4,349,492

[45] Sep. 14, 1982

[54] METHOD OF PUTTING IN A PARTITION OF INSULATION MATERIAL INSIDE CONCRETE WALLS WHICH ARE CAST IN A VERTICAL POSITION IN AN INDUSTRIAL BUILDING SITE

[76] Inventor: Dan Shoham, 67/D Rothschild Blvd., Haifa, Israel

[21] Appl. No.: 228,758

[22] Filed: Jan. 27, 1981

[30] Foreign Application Priority Data

Feb. 7, 1980 [IL] Israel ..... 59332

[51] Int. Cl.[3] ..... C04B 15/00

[52] U.S. Cl. ..... 264/35; 264/271.1; 264/333

[58] Field of Search ..... 264/35, 333, 271.1; 249/84, 85, 95, 96

[56] References Cited

U.S. PATENT DOCUMENTS 3,868,801 3/1975 Weiner ..... 264/35

*Primary Examiner*—John A. Parrish

*Attorney, Agent, or Firm*—Benjamin J. Barish

[57] ABSTRACT

A method of constructing in-situ cast concrete, internally insulated building walls, comprises the steps of erecting a wall mold having a pair of vertical, spaced, mold plates, introducing between, distanced from, and extending from bottom to top of the mold plates, an assembly comprising a rigid back-up panel and at least one board of insulating material releasably attached to one side of the panel, filling with poured concrete the spaces formed between the mold plates and the assembly, and before the concrete hardens, extracting the panel from the cast wall so that the board remains and becomes embedded in the concrete.

Two such insulating boards may be releasably attached to both sides of the panel, so that upon the extraction of the panel, the boards will gradually approach each other under the hydrostatic pressure of the concrete in which they are submerged, thus forming a substantially unified insulation layer.

10 Claims, 5 Drawing Figures

METHOD OF PUTTING IN A PARTITION OF INSULATION MATERIAL INSIDE CONCRETE WALLS WHICH ARE CAST IN A VERTICAL POSITION IN AN INDUSTRIAL BUILDING SITE

BACKGROUND OF THE INVENTION

This invention relates to a building construction method, particularly of exterior, thermal and acoustical insulated walls of the type having two cast concrete wall portions defining therebetween a cavity or space filled with insulating material.

Double wall construction of the type referred to were made of prefabricated building elements, installed so that a gap was left therebetween. Either the gap was unfilled so that the air itself served as an insulating substance, or the gap was filled with foamed plastics such as polyurethane.

There is also known a method of providing an air gap, within a cast-in-site wall, using an extractable core member as described in Israel Patent No. 49576, which gap may be filled with insulating material after the hardening of the concrete. One of the major disadvantages of such method, however, is that it inherently requires the hardening or curing of the concrete before the core is extracted and the insulating filling is introduced.

BRIEF SUMMARY OF THE INVENTION

It is the main object of the invention to provide a method of constructing insulated building walls which method is simple, inexpensive and most importantly, does not require a delay in the erecting process of the building to allow the hardening of the concrete.

It is another object of the invention to provide a method in which the concrete cast wall and its associated ceiling of the same building story are cast at substantially the same time and therefore become unified.

According to the invention there is provided a method of constructing in-situ cast concrete, internally insulated building walls, comprising the steps of erecting a wall mold having a pair of vertical, spaced mold plates; introducing between, distanced from, and extending from bottom to top of the mold plates, an assembly comprising a rigid back-up panel and at least one board of insulating material releasably attached to one side of said panel; filling with poured concrete the spaces formed between said mold plates and said assembly; and before the concrete hardens, extracting the panel from the cast wall so that the board remains and becomes embedded in the concrete.

It is particularly advisable that a second board be provided at the other side of the panel, so that the extraction of the panel from between the boards will cause them to approach each other, such that the engagement of the two boards forms a substantially unified insulation layer.

The method may include the following further steps: introducing a reinforcing mesh at one or both sides of the assembly; vibrating the concrete during the filling thereof; vibrating the concrete after the extraction of the panel; casting the ceiling associated with the wall immediately after the extraction of the panel; greasing the outer surfaces of the panel to facilitate the extraction thereof; releasably clamping the board(s) to the panel, to hold the assembly together during the handling thereof; preparing a channel-like recess at the bottom of the wall for receiving the lower edge of the assembly between the mold plates; and providing spacer means for holding the upper edge of the assembly between the mold plates.

BRIEF DESCRIPTION OF THE DRAWINGS

These and further constructional features and advantages of the present invention will become apparent from the following description of a preferred embodiment of the invention, described with reference to the accompanying drawings, wherein.

DESCRIPTION OF A PREFERRED EMBODIMENT

Figure 1:
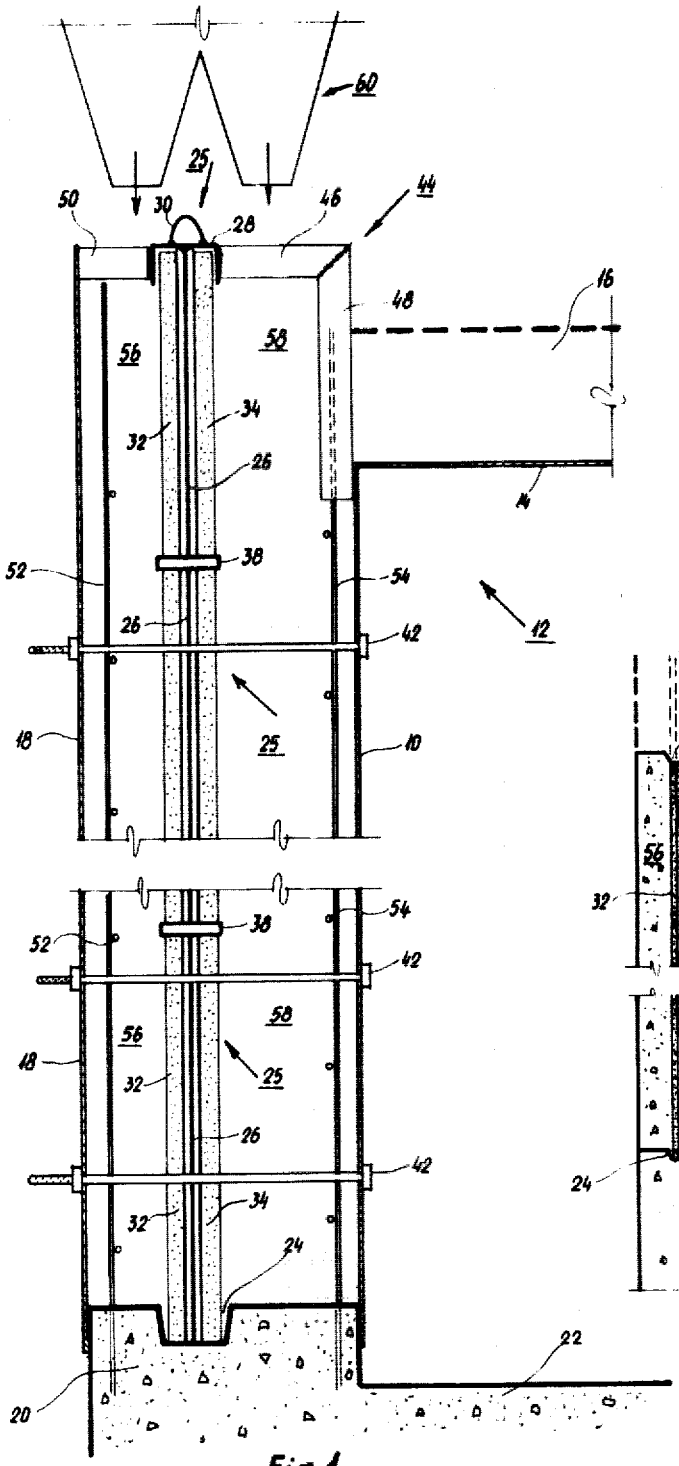
FIG. 1 is a cross-sectional view of a wall prepared for the concrete casting according to the method of this invention.

In FIG. 1 there is shown an inner mold plate 10 forming, in this case, one side of a tunnel 12 also having a ceiling mold plate 14 over which a ceiling 16 would be cast at a later stage, as will be described below. Such tunnels are well known in the industry of building constructions and need not be further described. However, it will be appreciated that any other kind of a mold plate for the inner side of the constructed wall may be used for the purpose of the present invention.

Outer mold plate 18 is again of any type used in conventional building constructions, and may be supported by any known means.

Figure 5:
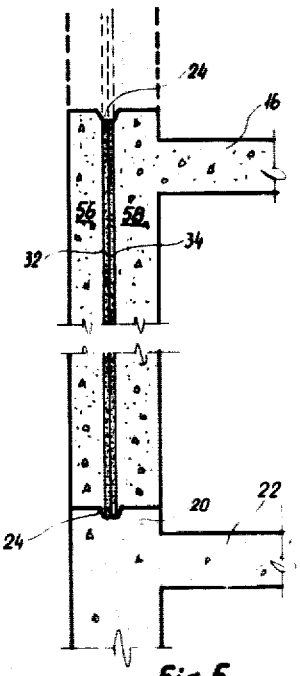
FIG. 5 is a cross-section of a completed wall and associated ceiling.

The wall to be erected is supported on a previously cast base 20, which is preferably shaped as shown, namely being somewhat elevated relative to floor 22 of the lower building story (see FIG. 5) and including an elongated channel-like recess 24 molded into the concrete after the erection of the complete wall and the ceiling of the said story.

Figure 2:
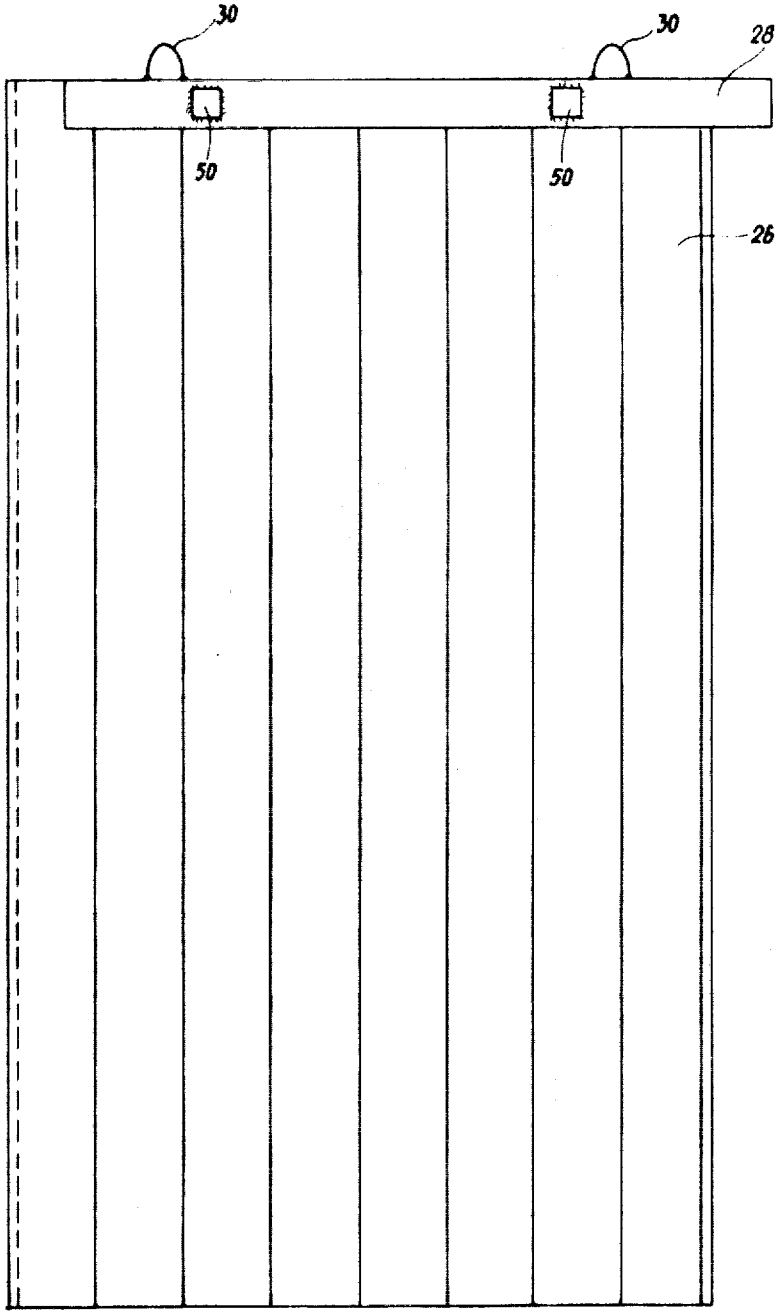
FIG. 2 is an elevation of the extractable back-up panel.

At suitable distances between the mold plates 10 and 18, usually further from the inner plate 10 than from the outer plate 18, an assembly generally indicated 25 is placed. The assembly comprises: a corrugated or zigzag shaped metal back-up panel 26, provided with a U-shaped profile 28 and lifting handles 30 welded to the top edge of the panel 26 (see FIGS. 2 and 4); a first board 32 of heat insulating material such as foamed polystyrene or polyurethane attached to and covering one side of the panel 26; and a second heat insulating board 34 attached to the other side of said board. The boards 32 and 34 are preferably held together, to form the sandwich assembly 25, by springy brackets 38 (FIG. 3) provided along the vertical edges of the assembly 25.

Figure 3:
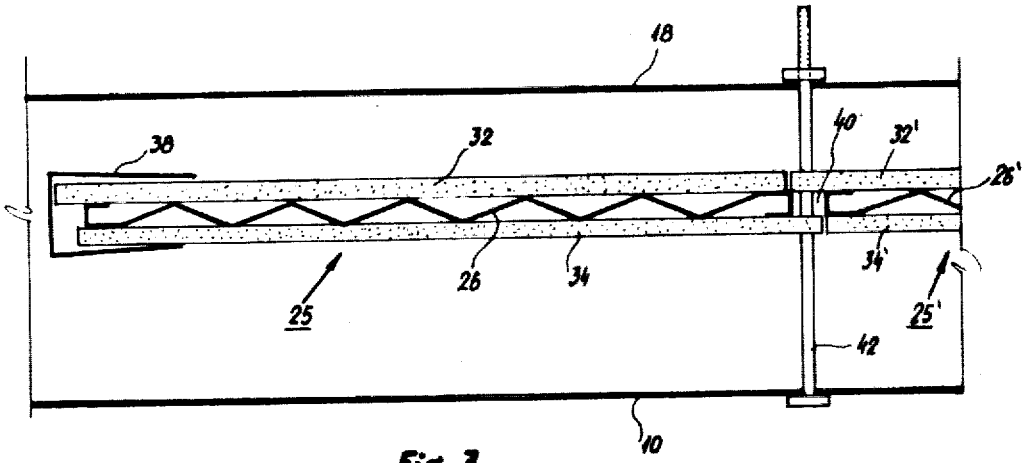
FIG. 3 is a top view of a wall section shown in FIG. 1.

Should the width of the panel 26 be less than the length of the to-be-erected wall, then a series of side-by-side arranged panels 26, 26' etc. may be used (see FIG. 3), and in this case it is preferred to have boards 32 and 32' and 34 and 34' arranged in the overlapping offset relationship illustrated in FIG. 3, to cover gap 40 between adjacent panels. In such a case, distancing and holding bolts 42 may be used, passing through the mold plates and one marginal portion of board 34 and an opposite marginal portion of board 32', as shown in FIG. 3. The bolts 42 will thus not interfere with the lifting and extraction of the panels 26, as will be described hereinbelow.

Figure 4:
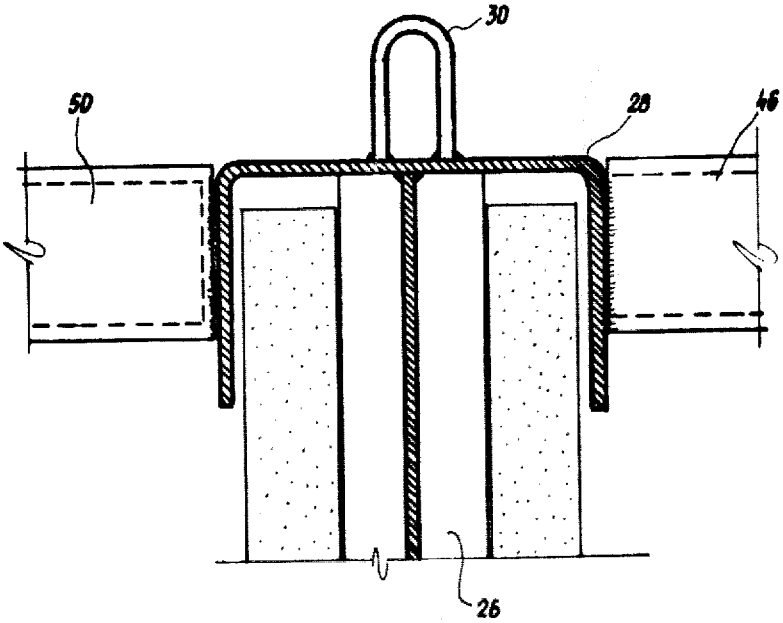
FIG. 4 shows a detail of the top panel portion.

There are further provided spacer means for assuring the correct vertical position of the assembly 25, in alignment with the channel 24, in the form of an angled member or bracket 44 having one leg thereof 46 welded to the profile 28, as shown in FIGS. 1 and 4, and its other leg 48 abutting against the inner mold plate 10. The assembly is supported from the opposite side by another bracket 50 suitably connected in a releasable manner to the outer mold plate 18.

If necessary, reinforcing metal meshes, 52 and 54 are placed within the to-be-erected wall spaces as shown.

The performance of the method according to the present invention with the mentioned equipment will now be described. The sandwiched assembly 25 (or a series of such assemblies) is separately prepared in the following manner. The back-up panel 26 is preferably first greased to facilitate the retrieval or extraction thereof, as will be described below. A complementary sized board 32 is releasably attached to, while abutting against the linear crests of, the panel 26. Although it would be well within the scope of the present invention to have only one board (32 or 34) used to form the insulating layer or partition of the wall, it is advisable—in order to save a cleaning process of the metal panel 26—to use a double board or sandwich assembly. Hence the boards 32 and 34 and the sandwiched panel are assembled and temporarily attached to form a unified body by the U-shaped springy clamps 38 at appropriate places along the sides and/or bottom of the assembly 25 (two such clamps are shown in FIG. 1).

The reinforcing meshes 52 and 54 are placed in position as shown in FIG. 1 and may be supported by their respective mold plates 10 and 18 in a well known manner.

The assembly 25, including the panel 26; the two boards 32, 34; the profile 28; and the spacing bracket 44, is lifted by a crane and inserted into the space between the mold plates 10 and 18, the bottom edge being received within the channel 24.

After securing the assembly 25 against sidewise movement by means of the brackets 44 and 50, concrete is then poured from a concrete pump into the two spaces 56 and 58 defined at both sides of the assembly 25, preferably by a two-way funnel 60 schematically shown in FIG. 1. It would also be advisable to vibrate the concrete at this stage especially at the outside space 56.

Immediately after filling the spaces 56 and 58 up to the top level defined by mold plate 14, the panel (or panels) 26 is lifted by any suitable hoisting means and extracted from between the boards 32 and 34. Consequently, the boards 32 and 34, no longer being positively spaced by the panel 26, will gradually approach each other and become engaged under the hydrostatic pressure of the concrete in which they are submerged. If necessary, further vibrating, e.g., by a needle vibrator, may be performed.

This completes the fabrication of the insulated wall, which now may be left to harden before the mold plates are removed. However, it is preferred to directly proceed with the casting of the ceiling 16 which thereby becomes unified with the upper portion of the previously cast wall. At the same time the channel 24 is molded at the upper surface of the wall, to prepare for the casting of the next, upper wall.

Many other applications, modifications and variations of the invention will be apparent.

What is claimed is:

1. A method of constructing in-situ cast concrete, internally insulated building walls, comprising the steps of:

(a) erecting a wall mold having a pair of vertical, spaced, mold plates;

(b) introducing between, distanced from, and extending from bottom to top of the mold plates, an assembly comprising a rigid back-up panel and at least one board of insulating material releasably attached to one side of said panel;

(c) filling with poured concrete the spaces formed between said mold plates and said assembly; and (d) before the concrete hardens, extracting said panel from the cast wall so that said board remains and becomes embedded in the concrete.

2. The method as claimed in claim 1 wherein said assembly comprises a second board of insulating material releasably attached to the other side of the panel, so that after the panel has been extracted from between the boards, the boards are moved towards each other by the unhardened concrete to form a substantially unified insulation layer.

3. The method as claimed in claim 1, including the further step of casting a ceiling over the wall immediately after the extraction of the panel.

4. The method as claimed in claim 1, including the further step of vibrating the concrete after the extraction of the panel.

5. The method as claims in claim 1, including the further step of releasably clamping the board(s) to the panel, to releasably hold the assembly together during the handling thereof.

6. The method as claimed in claim 1, wherein said panel is of corrugated sheet metal.

7. The method as claimed in claim 6 wherein said board is of foamed plastics.

8. The method as claimed in claim 1 wherein one of said mold plates constitutes one side wall of a concrete casting tunnel.

9. The method as claimed in claim 1, including the further steps of preparing a channel-like recess at the bottom of the wall for receiving the lower edge of the assembly between the mold plates, and providing spacer means for holding the upper edge of the assembly between the mold plates.

10. The method as claimed in claim 9 wherein a plurality of successively side-by-side arranged assemblies are provided for completing the wall, bolts being provided between successive assemblies, extending between the mold plates and passing through extended marginal portions of said board(s).

* * * * *